US007252162B2

(12) United States Patent
Akinlade et al.

(10) Patent No.: US 7,252,162 B2
(45) Date of Patent: Aug. 7, 2007

(54) METHOD AND DEVICE FOR INJECTING A FLUID INTO A FORMATION

(75) Inventors: Monsuru Olatunji Akinlade, Rijswijk (NL); Dirk Jacob Ligthelm, Rijswijk (NL); Djurre Hans Zijsling, Rijswijk (NL)

(73) Assignee: Shell Oil Company, Houston, TX (US)

( * ) Notice: Subject to any disclaimer, the term of this patent is extended or adjusted under 35 U.S.C. 154(b) by 391 days.

(21) Appl. No.: 10/497,444

(22) PCT Filed: Dec. 2, 2002

(86) PCT No.: PCT/EP02/13610

§ 371 (c)(1),
(2), (4) Date: Jun. 1, 2004

(87) PCT Pub. No.: WO03/048508

PCT Pub. Date: Jun. 12, 2003

(65) Prior Publication Data

US 2005/0011678 A1 Jan. 20, 2005

(30) Foreign Application Priority Data

Dec. 3, 2001 (EP) ..... 01204658

(51) Int. Cl.
*E21B 7/18* (2006.01)

(52) U.S. Cl. ..... 175/72; 166/279

(58) Field of Classification Search ..... None
See application file for complete search history.

(56) References Cited

U.S. PATENT DOCUMENTS 4,030,545 A 6/1977 Nebolsine ..... 166/191
5,060,737 A * 10/1991 Mohn ..... 175/104
5,271,462 A 12/1993 Berzin ..... 166/191
5,353,637 A 10/1994 Plumb et al. ..... 73/151
5,799,733 A 9/1998 Ringgenberg et al. ..... 166/264

(Continued)

FOREIGN PATENT DOCUMENTS

RU 2077655 4/1997

(Continued)

OTHER PUBLICATIONS

International Search Report dated Jan. 23, 2003.

(Continued)

*Primary Examiner*—Frank Tsay

(57) ABSTRACT

A method of injecting a stream of treatment fluid into an earth formation in the course of drilling a borehole into the earth formation, using an assembly having a drill string provided with at least one sealing means arranged to selectively isolate a selected part of the borehole from the remainder of the borehole, the drill string further being provided with a fluid passage for the stream of treatment fluid into the selected part of the borehole, the method involving:

operating the drill string, and stopping the drilling operation when a zone for which treatment is desired is arranged adjacent to the part of the selected part of the borehole;

isolating the selected part of the borehole using the sealing means so as to seal the drill string relative to the borehole wall; and, pumping the stream of treatment fluid via the fluid passage into the selected part of the borehole and from there into the treatment zone.

17 Claims, 5 Drawing Sheets

U.S. PATENT DOCUMENTS

| | | | | |
|---|---|---|---|---|
| 6,148,912 | A | 11/2000 | Ward | 166/250.07 |
| 6,157,893 | A | 12/2000 | Berger et al. | 702/9 |
| 6,427,530 | B1 * | 8/2002 | Krueger et al. | 73/152.46 |
| 6,981,560 | B2 * | 1/2006 | Nguyen et al. | 175/70 |

FOREIGN PATENT DOCUMENTS

| | | |
|---|---|---|
| SU | 1548414 | 3/1990 |
| SU | 1559110 | 4/1990 |

OTHER PUBLICATIONS

SPE 52794, Applications for an LWD Formation Tester, M. Hooper, SPE, C. MacDonald, SPE, R. Shalhope, and P. Boonen, SPE, Pathfinder Energy Services, 1999, Society of Petroleum Engineers, Inc. pp. 1-8.

Third Wave Group online Brochure, "Introducing the Multiple Activation PBL Bypass System", pp. 1-5, http://web.archive.org/web/20020806193519/thirdwavegroup.com/scripts/dsi.cfm.

DSI Brochure, "P.B.L. Bypass System Rig Operating Procedures", http://web.archive.org/web/20020806193519/thirdwavegroup.com/scripts/dsi.cfm.

* cited by examiner

METHOD AND DEVICE FOR INJECTING A FLUID INTO A FORMATION

FIELD OF THE INVENTION

The present invention relates to an assembly and a method for injecting a stream of fluid into an earth formation using a borehole formed in the earth formation.

BACKGROUND OF THE INVENTION

During drilling of a borehole into the earth formation for the production of oil or gas, it frequently occurs that chemical treatment of the rock formation is required. For example in case of large losses of drilling fluid into fractures in the formation, shutting off of such fractures is necessary to prevent such further fluid losses. Such fractures may also lead to poor cementation of wellbore casing when drilling is done in overbalance mode, or to early breakout of reservoir water in case the fractures are connected to a water layer when the well is put on production. Similar problems as described above with regard to fractures can also be encountered when highly permeable zone of the earth formation are traversed during drilling, and the present invention is equally applicable to this situation. A highly permeable zone, wherein the permeability is for example at least 10 times higher than the average permeability of the earth formation that is traversed, is for example prone to early water breakthrough. Sealing off fluid communication between the borehole and the highly permeable region can therefore be desirable.

However, contamination of treatment fluid with drilling mud in the borehole during overbalanced drilling and the difficulty to place treatment fluid in the formation on the high side of the well, has negatively affected the treatment success. Injection of treatment chemical into the surrounding formation is normally avoided when drilling in the underbalance mode since such injection can only be achieved in overbalance mode, and switching to overbalance mode would necessitate the whole fluid column in the borehole becoming overbalanced.

Thus, there is a need to provide an improved method and assembly which allows placement of treatment fluid while drilling in the overbalance mode without mixing of treatment fluid with the drilling mud, and which allows placement of treatment fluid while drilling in the unbalance mode while the borehole outside the treatment zone still remains underbalanced.

SUMMARY OF THE INVENTION

In accordance with the invention there is provided a method of injecting a stream of treatment fluid into an earth formation in the course of drilling a borehole into the earth formation, so as to suppress fluid communication between the borehole and a fracture or a highly permeable region in the earth formation, using an assembly comprising a drill string extending into the borehole, the drill string being provided with at least one sealing means arranged to isolate a selected part of the borehole from the remainder of the borehole, each sealing means being rotatable relative to the drill string and being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of treatment fluid, the fluid passage having an outlet debauching into the selected part of the borehole, which method comprises the steps of:

- operating the drill string so as to progress the borehole until a treatment zone, which treatment zone includes the fracture or the highly permeable region, in the earth formation is reached for which treatment is desired;
- stopping the drilling operation when the treatment zone is arranged adjacent to the part of the borehole which is selected by the arrangement of the sealing means on the drill string;
- moving the sealing means from the retracted mode to the expanded mode thereof so as to seal the drill string relative to the borehole wall; and
- pumping the stream of treatment fluid via the fluid passage and the outlet into the selected part of the borehole and from there into the treatment zone, wherein the drill string is rotated during pumping and/or during a curing period of the treatment fluid after pumping.

There is further provided a method of injecting a stream of treatment fluid into an earth formation in the course of underbalanced drilling of a borehole into the earth formation, so as to suppress fluid communication between the borehole and a fracture or a highly permeable region in the earth formation, using an assembly comprising a drill string extending into the borehole, the drill string being provided with at least one sealing means arranged to isolate a selected part of the borehole from the remainder of the borehole, each sealing means being movable between a radially retracted mode in which the sealing means is radially displaced from the borehole wall and a radially exdanded mode in which the sealing means is biased against the borehole wall so as to seal the drill string relative to the borehole wall, the drill string further being provided with a fluid passage for the stream of treatment fluid, the fluid passage having an outlet debouching into the selected part of the borehole, which method comprises the steps of:

- operating the drill string in underbalance mode so as to progress the borehole until a treatment zone in the earth formation is reached, which treatment zone includes the fracture or the highly permeable formation, for which treatment is desired;
- stopping the drilling operation when the treatment zone is arranged adjacent to the part of the borehole which is selected by the arrangement of the sealing means on the drill string;
- moving the sealing means from the retracted mode to the expanded mode thereof so as to seal the drill string relative to the borehole wall; and
- pumping the stream of treatment fluid via the fluid passage and the outlet into the selected part of the borehole and from there into the treatment zone.

The assembly for injecting a stream of fluid into an earth formation as provided by the present invention comprises a drill string extending into the borehole, the drill string being provided with at least one sealing means arranged to isolate a selected part of the borehole from the remainder of the borehole, each sealing means being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of fluid, the fluid passage having an outlet debouching into the selected part of the borehole, wherein each sealing means includes an inflatable member movable between a radially retracted position when the sealing means is in the retracted mode and a radially expanded position when the sealing means is in the expanded mode, and wherein each inflatable member is arranged to be inflated by means of the pressure in the fluid passage when the stream of treatment fluid is injected, wherein each inflatable member includes a fluid chamber and an inflation channel having an outlet debauching into the fluid chamber, and wherein the drill string further comprises a means for selectively providing fluid communication between the inflation channel and the fluid passage, and wherein the means for selectively providing fluid communication comprises a tubular sleeve arranged on the inner surface of a tubular portion of the drill string, wherein the tubular sleeve is axially movable between a closing position and an opening position with respect to a port through the wall of the tubular portion, and wherein moving the tubular sleeve from the closing to the opening position opens fluid communication through the port, and thereby between the fluid passage, of which the interior of the tubular portion forms part, and the inflation channel.

The method of the present invention allows to selectively treat a treatment zone of the formation such as a fracture or a highly permeable zone, by pumping treatment fluid down the drill pipe. In particular, such a treatment zone can be sealed so as to suppress fluid communication between the borehole and the treatment zone after treatment, so that fluid losses into or water influx from the treatment zone are prevented. To this end, the treatment fluid is suitably a treatment chemical which can seal fractures or pores after curing or after a reaction with the formation rock. Cement can also be used. The present invention therefore allows such treatment to be conducted in the course of a drilling operation without the need to pull the drill string out of the borehole, if needed for a number of formation zones which may need to be treated at different depths. The method is both applicable for treatment in the course of overbalance and underbalance drilling.

By moving the sealing means from the retracted mode to the expanded mode, the selected part of the borehole is isolated from the remainder of the borehole, so that the treatment fluid which is pumped into the isolated borehole part is not mixed with the drilling fluid present in the remaining borehole part. Also, the pressure of the treatment fluid in the isolated borehole part is independent from the pressure in the remainder borehole part so that the remainder part can remain at underbalanced pressure during the injection process. The sealing means in the apparatus of the present invention comprises an inflatable member such as a packer, which is arranged to be inflated by means of the pressure in the fluid passage when the stream of treatment fluid is injected. In this way, a simple and fail-safe operation can be achieved, since the inflatable packer is inflated and kept inflated when the treatment fluid is injected.

Suitably the sealing means includes a primary sealing means arranged so that said outlet is located between the primary sealing means and the lower end of the drill string.

The sealing means can include a secondary sealing means arranged so that said outlet is located between the primary sealing means and the secondary sealing means.

To allow continued rotation of the drill string in the course of the injection process, i.e. during the injection and/or any curing period thereafter, suitably each sealing means is rotatable about the longitudinal axis of the drill string. In this way it can for example be prevented that the drill string gets stuck in the borehole after injection of a treatment chemical.

BRIEF DESCRIPTION OF THE DRAWINGS

The invention will be described hereinafter in more detail and by way of example with reference to the accompanying drawings in which.

In the Figures like reference numerals relate to like components.

DETAILED DESCRIPTION OF THE INVENTION

Figure 1:
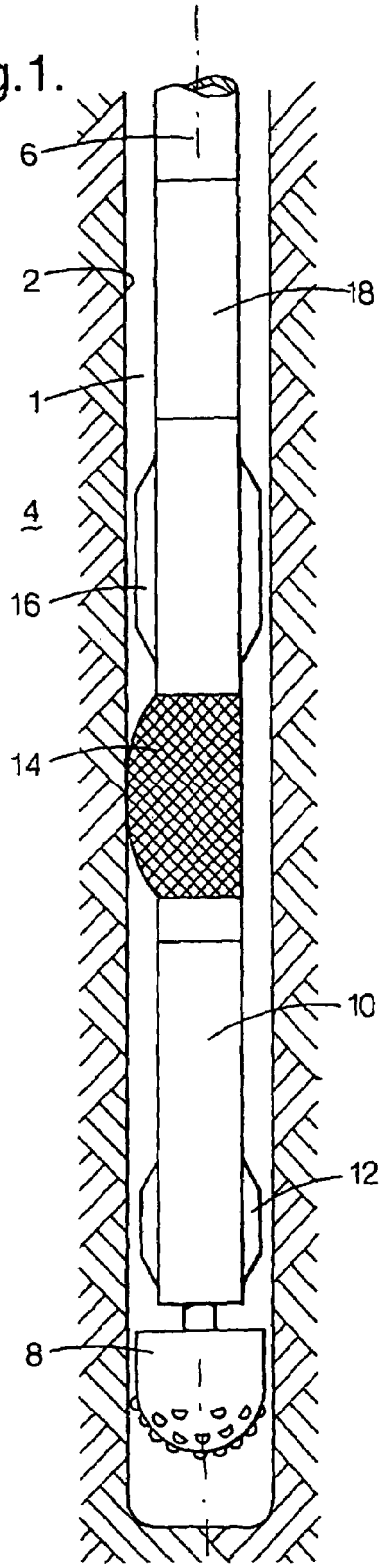
FIG. 1 schematically shows a first embodiment of the assembly of the invention.

Referring to FIG. 1 there is shown a drill string 1 extending into a borehole 2 formed in an earth formation 4, the drill string having a longitudinal axis 6. The lower part of the drill string 1 includes, subsequently in upward direction, a drill bit 8, a hydraulic motor 10 (also referred to as mud-motor) for rotating the drill bit 8, a lower stabiliser 12 provided at the housing of the motor, a sealing means in the form of an inflatable packer 14, an upper stabiliser 16, and a measurement while drilling (MWD) tool 18. The inflatable packer 14 is shown in inflated mode at the left side of the longitudinal axis 6, and in deflated mode at the right side of the longitudinal axis 6.

Figure 2:
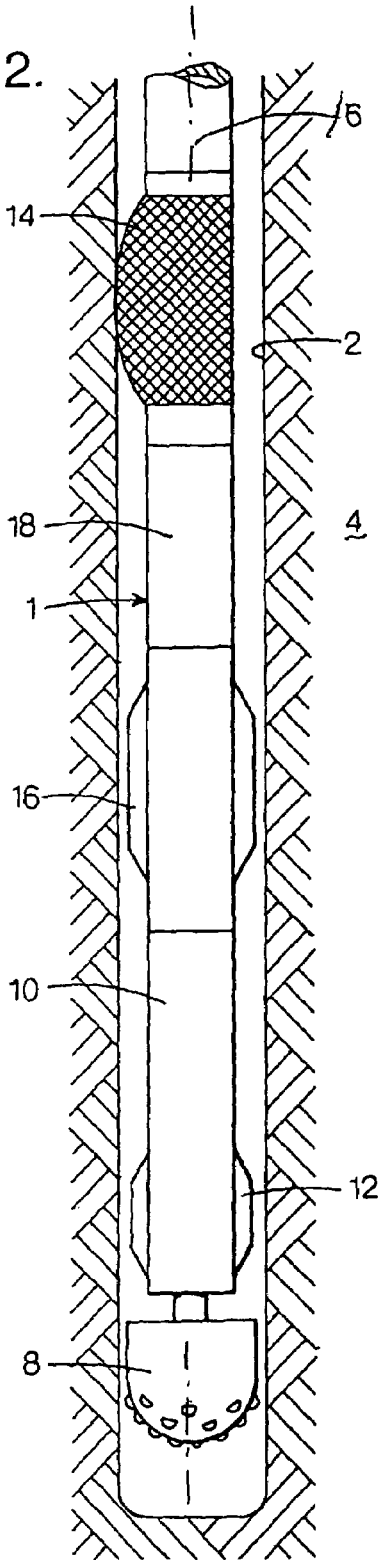
FIG. 2 schematically shows a second embodiment of the assembly of the invention.

In FIG. 2 is shown a drill string 1 extending into a borehole 2 formed in an earth formation 4, the drill string having a longitudinal axis 6. The lower part of the drill string 1 has substantially the same components as the lower part of the drill string of FIG. 1, the difference being that in FIG. 2 the inflatable packer 14 is arranged on top of the MWD tool 18 rather than between the mud-motor 10 and the upper stabiliser 16 as in FIG. 1. Again, the inflatable packer 14 is shown in inflated mode at the left side of the longitudinal axis 6, and in deflated mode at the right side of the longitudinal axis 6. The fluid passage of the assemblies in FIGS. 1 and 2 is formed by the interior of the drill string 1 and the outlet of the fluid passage by nozzles provided in the drill bit 8.

Figure 3:
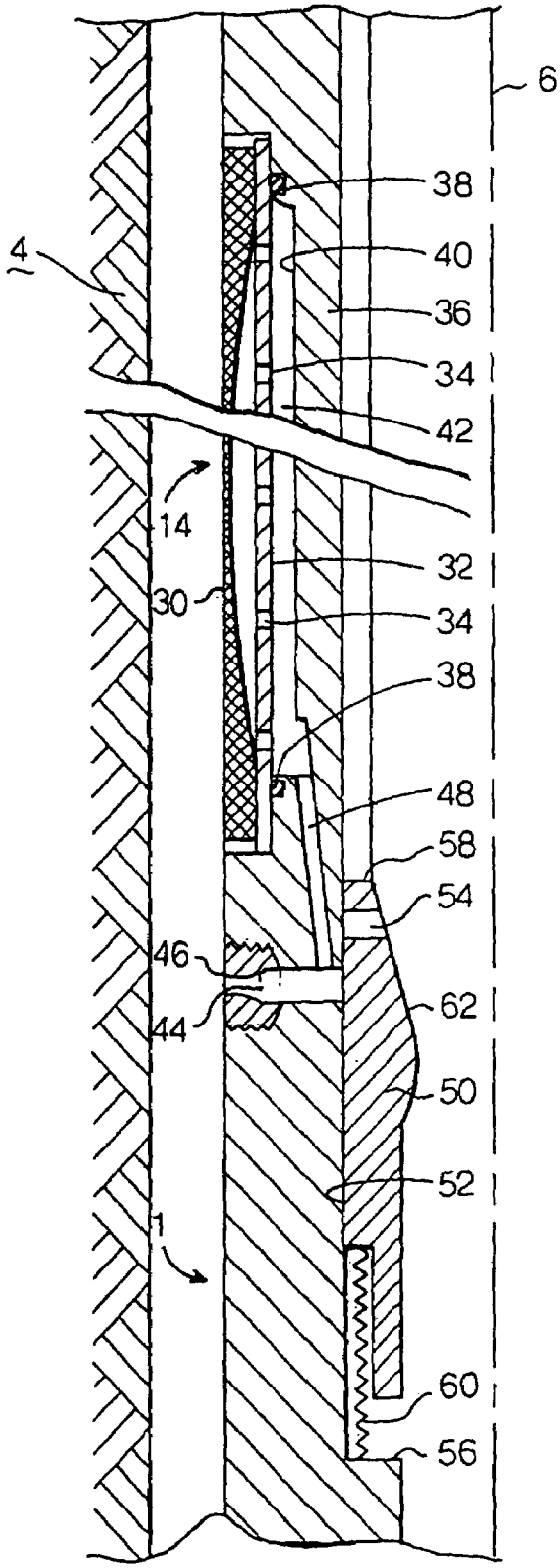
FIG. 3 schematically shows an activation system of sealing means when in retracted mode.

In FIG. 3 is shown the inflatable packer 14 and its activation system in more detail. The packer 14 includes an annular rubber packer element 30 connected to a sleeve 32 provided with holes 34. The sleeve 32 is connected to a tubular portion 36 of the drill string 1 by means of bearings 38 so as to allow the sleeve 32 to rotate relative to tubular drill string portion 36. An annular recess 40 in tubular portion 36 defines an annular fluid chamber 42 between the sleeve 32 and the tubular portion 36. A port 44 is formed in the wall of tubular portion 36, which port includes a nozzle 46 and provides fluid communication between the interior and the exterior of the tubular portion 36.

A channel 48 extending from the port 44 in the wall of tubular portion 36 to an outlet debouching into the fluid chamber 42 provides fluid communication between the port 44 and the fluid chamber 42. A tubular sleeve 50 is arranged at the inner surface 52 of the tubular portion 36, which sleeve 50 is provided with an opening 54 in the wall thereof. The sleeve 50 is slideable in axial direction along the tubular portion 36 between a closed position (FIG. 3) in which the port 44 is closed off by sleeve 50, and an open position (FIG. 4) in which the opening 54 is aligned with port 44. Shoulders 56, 58 formed at the inner surface 52 of the tubular portion 36 define the respective end positions for axial movement of the sleeve 50. A spring 60 is provided between the shoulder 56 and the sleeve 50 so as to bias the sleeve 50 to its closed position. The sleeve 50 has an inner surface 62 which tapers radially inward in downward direction.

Figure 4:
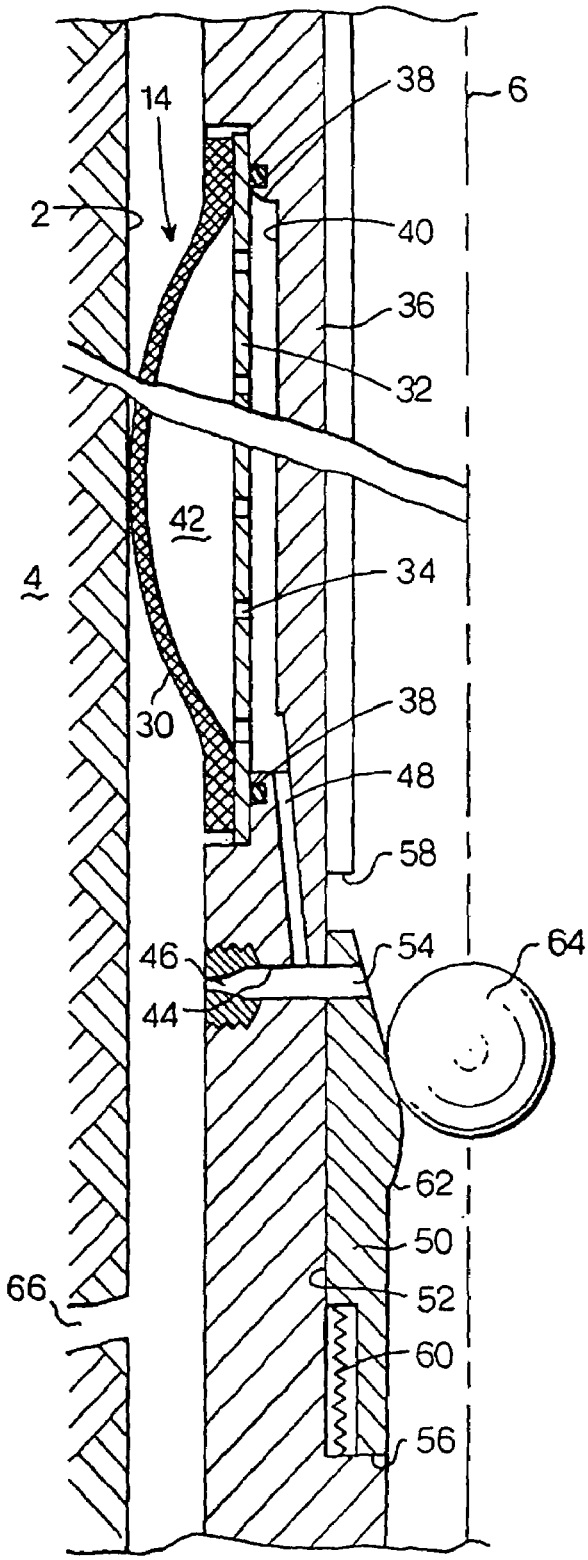
FIG. 4 schematically shows the activation system of sealing means when in expanded mode.

FIG. 4 shows the inflatable packer 14 and activation system of FIG. 3 when in inflated mode, whereby a flexible ball 64 seats on tapering inner surface 62 of slideable sleeve 50, and whereby the earth formation 4 has a fracture 66. The fluid passage for treatment fluid is formed by the interior of the drill string 1, the opening 54, the port 44 and the nozzle 46. An inflation channel for the fluid chamber is formed by the opening 54, part of the port 44, and the channel 48.

Figure 5:
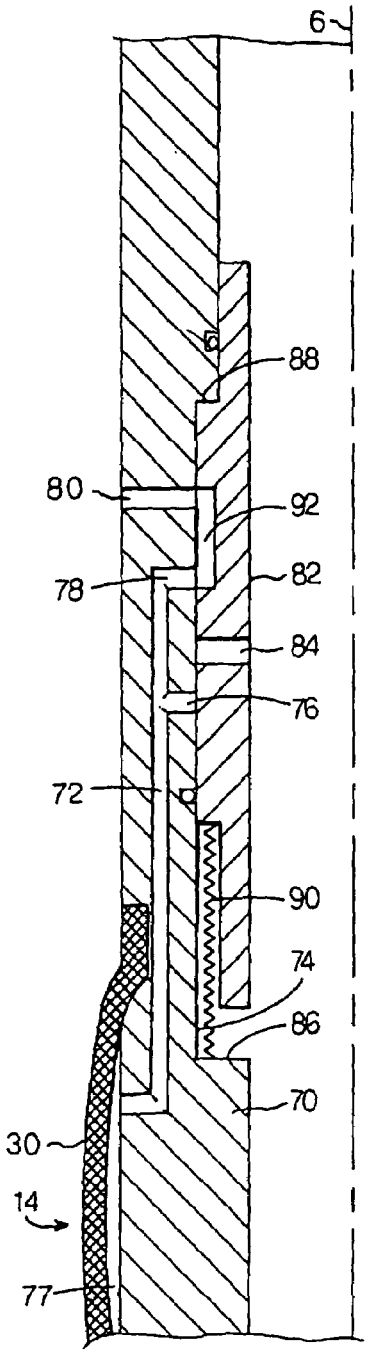
FIG. 5 schematically shows an alternative activation system of sealing means when in retracted mode.

In FIG. 5 is shown an alternative activation system of inflatable packer 14. Here the rubber packer element 30 is directly connected to the outer surface of tubular drill string portion 70 whereby a fluid chamber 71 is formed between the packer element 30 and the outer surface of the tubular portion 70.

A longitudinal channel 72 extending through the wall of tubular portion 70 provides fluid communication between the fluid chamber 71 and the inner surface 74 of tubular portion 70 via a first transverse channel 76 and second transverse channel 78 axially displaced from the first transverse channel 76. A port 80 formed in the wall of tubular portion 70 at some axial distance from the second transverse channel 78, provides fluid communication between the interior and the exterior of the tubular portion 70. A tubular sleeve 82 arranged at the inner surface 74 of the drill string portion 70 is provided with an opening 84 in the wall thereof. The sleeve 82 is slideable in axial direction along the tubular portion 70 between a closed position (FIG. 5) in which the first transverse channel 76 is closed off by sleeve 82, and an open position (FIG. 6) in which the opening 84 is aligned with first transverse channel 76. Shoulders 86, 88 formed at the inner surface 74 of the tubular portion 70 define the respective end positions of axial movement of the sleeve 82. A spring 90 is provided between the shoulder 86 and the sleeve 82 so as to bias the sleeve to its closed position. The sleeve 82 is furthermore provided with a recess 92 arranged to provide fluid communication between the second transverse channel 78 and the port 80 when the sleeve 82 is its closed position. The port 80 is closed off by sleeve 82 when the sleeve 82 is in its open position.

Figure 6:
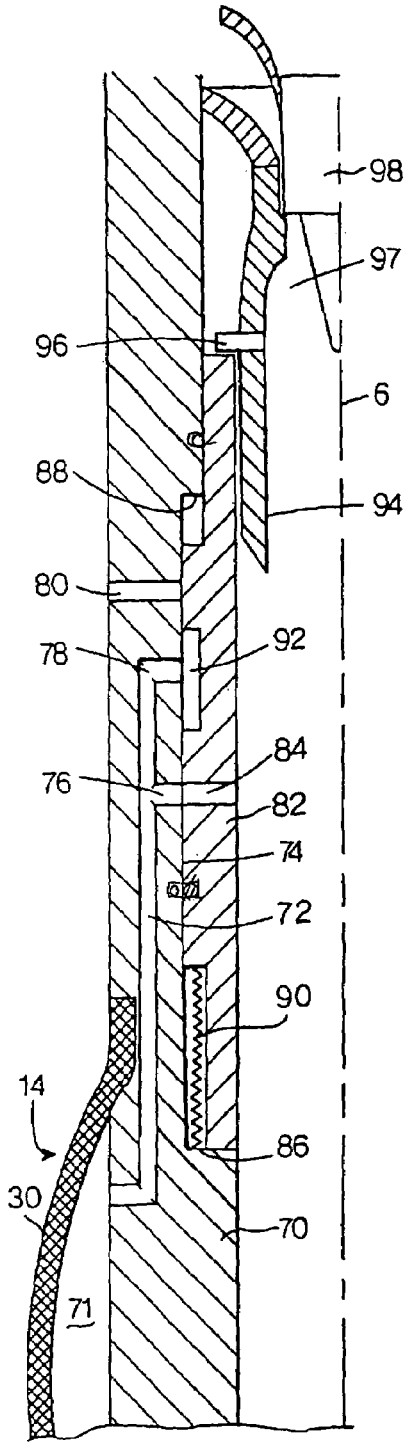
FIG. 6 schematically shows the alternative activation system of sealing means when in expanded mode.

FIG. 6 shows the packer 14 and activating system of FIG. 5 when in inflated mode, whereby a first dart 94 seats against the upper end of sleeve 82 by means of one or more shear pins 96 connected to the first dart 94. The first dart 94 has a central opening in the form of flow restriction 97, whereby a second dart 98 is seated against the first dart 94 so as to close off the flow restriction 97. When the second dart 98 is not present, the fluid passage is formed by the interior of the drill string, the first dart, and an outlet into the borehole below the packer 14 (not shown). In FIG. 6, an inflation channel is formed by the opening 86, the first traverse channel 76, the longitudinal channel 72 debouching into fluid chamber 71.

Figure 7:
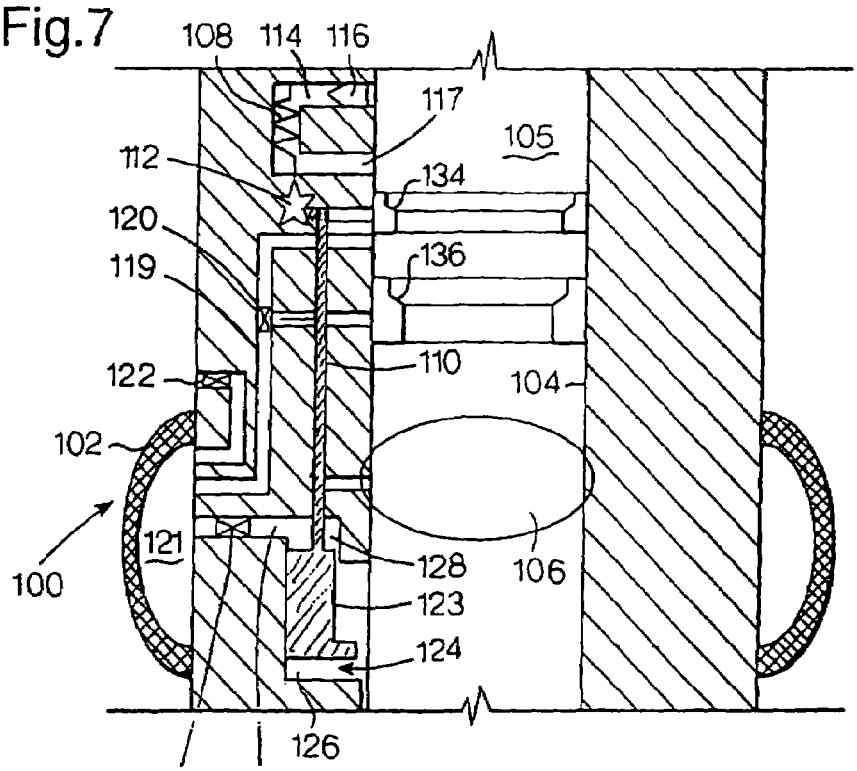
FIG. 7 schematically shows a further activation system of sealing means when in retracted mode.

Referring to FIG. 7 there is illustrated a further embodiment of an inflatable packer arrangement 100. The packer 100 includes an annular rubber packer element 102 connected to a tubular drill string portion 104. A ball valve 106 is arranged in the tubular portion 104 to open and close the bore 105 thereof. A turbine 108 is arranged in the tubular portion 104 to move a slideable rod 110 up or down via an actuating cam 112, whereby the valve 106 is controlled by up- or downward movement of the rod 110. The turbine 108 has a fluid inlet 114 provided with nozzle 116 and a fluid outlet 117, both being in fluid communication with the bore 105. The turbine is designed such that it is activated only when the mud flow rate in bore 105 is above a predetermined rate which is below the normal flow rate during drilling. The tubular portion 104 is provided with an inflation channel 119 providing fluid communication between the bore 105 and the annular chamber 121. A valve 120 controlled by rod 110 is arranged in the channel 119. The tubular portion 104 is further provided with a relief valve 122 arranged to provide fluid communication between the annular chamber 121 and the exterior of the tubular drill string portion 104 above the packer element 102 at a selected pressure difference across the relief valve 122. The rod 110 is at its lower end provided with a double-acting piston 123 movable in a chamber 124. The chamber 124 has a portion 126 at the lower side of the piston 123 filled with pressurized nitrogen, and a portion 128 at the upper side of the piston in fluid communication with the annular chamber 121 via a passage 130 provided with valve 132. The valve 132 is designed to open only when the fluid pressure in the annular chamber 121 exceeds the nitrogen pressure in portion 126 of chamber 124 by a selected amount. The bore 105 is provided with a first receptacle 134 and a second receptacle 136, both being connected to rod 110. The first receptacle 134 is arranged to move the rod 110 upwardly when a dart is pumped onto the first receptacle, and the second receptacle 134 is arranged to move the rod 110 downwardly when another dart is pumped onto the second receptacle.

Figure 8:
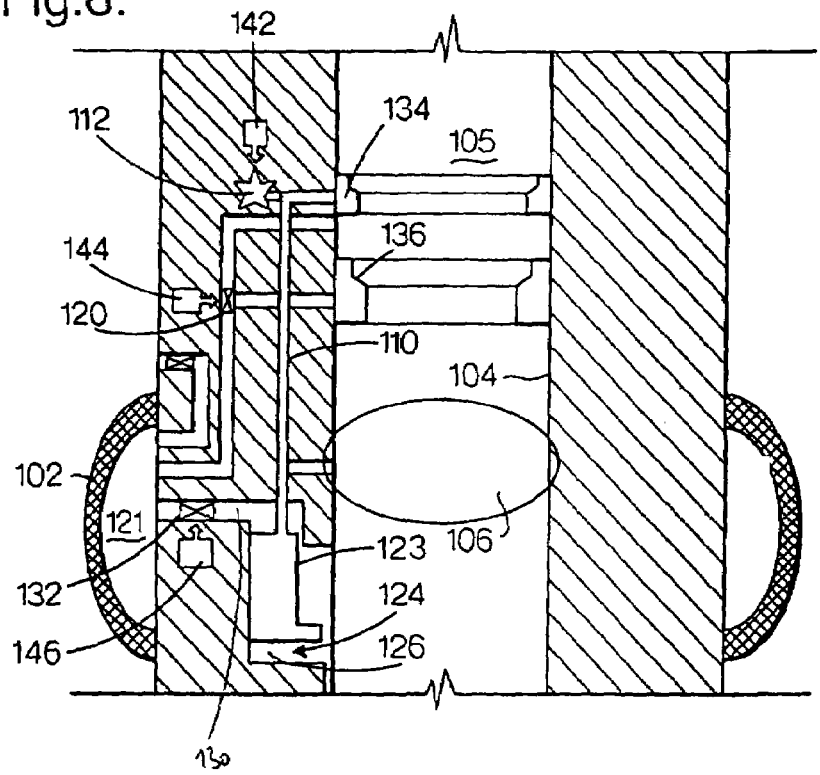
FIG. 8 schematically shows another activation system of sealing means when in expanded mode.

In FIG. 8 is shown another embodiment of an inflatable packer arrangement 140. This arrangement is largely similar to the embodiment of FIG. 7, except that the turbine 108 has been replaced by a solenoid 142 to control actuating cam 112. Furthermore, solenoids 144, 146 are provided to respectively control valve 120 and valve 132. In FIGS. 7 and 8, when the valve 106 is open, the fluid passage is formed by the interior of the drill string, valve 106, and an outlet into the borehole below the packer 102 (not shown).

During normal operation of the embodiment of FIG. 1, when it is desired to inject a chemical treatment fluid into the borehole 2, drilling is stopped and the packer 14 is inflated against the borehole wall, thereby selecting the part of the borehole below the packer 14.

A batch of treatment fluid is then pumped down from the earth's surface (not shown) via the drill string 1 and the fluid nozzles (not shown) of the drill bit 8 into the selected part of the borehole 2, and from there into the rock formation 4 surrounding the borehole 2. Thus, the treatment fluid does not enter the section of the borehole 2 above the packer 14, and the fluid pressure above the packer 14 is not affected by pumping of the treatment fluid. Depending on the characteristics of the treatment fluid, the packer 14 is deflated immediately after pumping the batch of fluid or a selected time period thereafter whereafter drilling can be resumed. The upper stabiliser 16 prevents inadvertent contact of the packer 14 with borehole wall during drilling, and centralizes the packer 14 in the borehole 2 when the packer is inflated. Instead of pumping the treatment fluid through the drill bit nozzles, the fluid can be pumped through a suitable opening (not shown) provided at the drill string 1. In the arrangement of FIG. 1 the packer 14 can be positioned close to the bit 8 so that a short section of the borehole can be isolated for treatment. Activation of the packer can in principle be achieved by means of darts or balls, however such darts or balls may not be able to pass the MWD tool 18. Therefore activation of the packer 14 can be achieved by means of signals, e.g. pressure pulses from the MWD tool 18.

Normal operation of the embodiment of FIG. 2 is substantially similar to normal use of the embodiment of FIG. 1 except that now darts or balls can be used for activation of the packer 14 since the MWD tool 18 is positioned below the packer 14.

During normal operation of the embodiment of FIGS. 3, 4 the flexible ball 64 is dropped onto the tapering inner surface 62 of the sleeve 50 when inadvertent drilling fluid losses into the fracture 66 occur. Treatment fluid is then pumped into the drill string 36, resulting in an increase of the pressure in the drill string 36 to a level whereby the ball 64 induces the sleeve 50 to shift from its upper position (FIG. 3) to its lower position (FIG. 4) against the force of spring 60. When the sleeve 50 comes into contact with shoulder 56, further movement of the sleeve 50 is prevented. In this position the opening 54 is aligned with port 44 so that treatment fluid is allowed to flow through the fluid passage, i.e. from the central bore of the drill string via the port 44 into the borehole 2, and from there into the fracture 66. Treatment fluid also flows along the inflation channel, i.e. from the port 44 via the channel 48 and the holes 34 of sleeve 32, into the annular fluid chamber 42 thereby inflating the packer element 30 against the borehole wall. The slideable sleeve arrangement therefore acts as means for providing fluid communication, both through the fluid passage, and between the fluid channel and the inflation channel. By virtue of the nozzle 46, the pressure drop of fluid flowing from the drill string 36 via port 44 into the borehole 2 is larger than the pressure drop of fluid flowing from the drill string 36 into the annular chamber 42. Therefore the inflation pressure of the packer 14 is higher than the fluid pressure in the borehole below the packer 14, and no fluid will leak upwardly along the packer 14. If desired the drill string 36 can be rotated during the injection process, whereby the inflated packer element 30 is allowed to remain stationary by virtue of bearings 38. After the treatment process is finalised, a steel ball (not shown) is dropped into the drill string 36 to plug off opening 54 of the sleeve 50. Upon arriving in sleeve 50, the steel ball plugs off opening 54. As a result a water hammer pressure pulse develops which causes the flexible ball 64 to be pushed through the seat of the sleeve 50. The steel ball will follow the soft ball 64 and the sleeve will move to the closed position again. At the same time the packer starts to deflate by venting fluid via channel 48 and port 44 into the borehole 2, which form a deflation channel. The balls are collected in a ball catcher (not shown). Several ball sets can be collected in the catcher to enable multiple injection jobs to be performed without having to make a roundtrip.

During normal operation of the embodiment of FIGS. 5, 6 the first dart 94 is pumped into the drill string 70 to seat on sleeve 82 when a chemical treatment of the rock formation surrounding the borehole into which the drill string 70 extends, is required. By virtue of the flow restriction of the first dart 94, continued pumping of fluid causes the dart 94 to slide the sleeve 82 from its closed position (FIG. 5) to its open position (FIG. 6) against the force of spring 90. When the sleeve 82 comes into contact with shoulder 86, further movement of the sleeve 82 is prevented. In this position the opening 84 is aligned with first transverse channel 76 so that fluid communication is provided between the interior of the drill string which forms part of the fluid passage and the inflation channel. Accordingly, treatment fluid is allowed to flow from the drill string 70 via the longitudinal channel 72 into the annular fluid chamber 71 thereby inflating the packer element 30 against the borehole wall. After the treatment process is finalised the second dart 98 is pumped into the drill string 70 to plug off the flow restriction of the first dart 94. Continued pumping causes the shear pins 96 to be sheared off so that both darts 94, 98 are pumped through the sleeve 82 and collected in a suitable dart catcher (not shown). Simultaneously, the spring 90 moves the sleeve 82 to its closed position again, allowing the fluid present in the annular chamber 71 to be vented to the borehole via the deflation channel formed by channel 72, second transverse channel 78, recess 92 and port 80.

During normal operation of the embodiment of FIG. 7, when a chemical compound is to be injected into the earth formation, the mud flow rate through the bore 105 of the drill string is increased above the predetermined flow rate in order to operate the turbine 108 which actuates the cam 112 so as to move the rod 110 upward thereby inducing the ball valve 106 to close the bore 105 and to open the valve 120. Mud is now allowed to flow through the inflation channel 119 and into annular chamber 121 thereby inflating rubber packer element 102 against the wellbore wall. When a predetermined pressure is reached in the annular chamber 121, mud flows from the annular chamber 121 via passage 130 and valve 132 into portion 128 of chamber 124 and pushes the piston 123 downward from its upper position to its lower position thereby compressing the nitrogen gas in chamber portion 126. As the pressure in annular chamber 121 attains its final pressure the piston 123 reaches its lowest point whereby the sliding rod 110 closes valve 120 and opens ball valve 106. It is expedient not to over-inflate the packer element 102 therefore any excess pressure in annular chamber 121 is relieved via the relief valve 122. In case activation of the cam 112 with turbine 108 fails, a dart can be pumped or dropped onto receptacle 134 whereafter the bore 105 can then be pressurized to shift the rod 110 upwardly thereby closing ball valve 106 and opening valve 120. With the ball valve 106 open, the treatment chemical is pumped through the drill string and via the nozzles of the drill bit into the lower well bore annulus where the chemical enters into the fracture treatment zone of the formation. After the injected chemical has cured in the formation, the packer element 102 is deflated by dropping and/or pumping a dart from the surface to seat in receptacle 136 whereafter the bore 105 can be pressurized so that receptacle 136 opens valve 120 thereby allowing mud to flow from annular chamber 121 via channel 119 into the drill string bore 105 while at the same time shearing the dart. The pumped dart also disengages the sliding rod 110 so that it can move from its lower position to its intermediate position as the mud in the annular chamber 121 flows into drill string bore 105. A spring (not shown) retracts the deflated packer element 102 into its recess (not shown) in the tubular drill string portion 104. When the sliding rod 110 reaches its intermediate position, the rod 110 closes the valve 120 and the cam 112 is reset to its original position.

Normal operation of the embodiment of FIG. 8 is substantially similar to normal operation of the embodiment of FIG. 7, except that the actuating cam is controlled by solenoid 142, and that the valves 120, 132 are controlled by respective solenoids 144, 146. Power for the operation of the solenoids can conveniently be provided by a down-hole battery pack (not shown) arranged situated in the drill string. A signal-receiving unit (not shown) detects coded mud pulse signals, for instance shock waves transmitted through the mud column from the surface, to operate the solenoids 142, 144, 146. This means of communication is already in use in the measurement while drilling (MWD) technology, whereby in the present application the coded mud pulse signals are based on information sent from downhole sensors to a surface detector and vice versa.

We claim:

1. A method of injecting a stream of treatment fluid into an earth formation in the course of drilling a borehole into the earth formation, so as to suppress fluid communication between the borehole and a fracture or a highly permeable region in the earth formation, using an assembly comprising a drill string extending into the borehole, the drill string being provided with at least one sealing means arranged to isolate a selected part of the borehole from the remainder of the borehole, each sealing means being rotatable relative to the drill string and being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of treatment fluid, the fluid passage having an outlet debouching into the selected part of the borehole, which method comprises the steps of:

operating the drill string so as to progress the borehole until a treatment zone in the earth formation is reached, which treatment zone includes the fracture or the highly permeable region, for which treatment is desired;

stopping the drilling operation when the treatment zone is arranged adjacent to the part of the borehole which is selected by the arrangement of the sealing means on the drill string;

moving the sealing means from the retracted mode to the expanded mode thereof so as to seal the drill string relative to the borehole wall; and pumping the stream of treatment fluid via the fluid passage and the outlet into the selected part of the borehole and from there into the treatment zone, wherein the drill string is rotated during pumping and/or during a curing period of the treatment fluid after pumping.

2. The method according to claim 1, wherein drilling is performed in the underbalance mode.

3. The method according to claim 1, wherein after the treatment fluid has been injected the sealing means is moved to the retracted mode, and drilling is resumed.

4. The method according to claim 1, wherein injection of treatment fluid is repeated in the course of a drilling operation for a number of treatment zones along the borehole.

5. A method of injecting a stream of treatment fluid into an earth formation in the course of underbalanced drilling of a borehole into the earth formation, so as to suppress fluid communication between the borehole and a fracture or a highly permeable region in the earth formation, using an assembly comprising a drill string extending into the borehole, the drill string being provided with at least one sealing means arranged to isolate a selected part of the borehole from the remainder of the borehole, each sealing means being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of treatment fluid, the fluid passage having an outlet debouching into the selected part of the borehole, which method comprises the steps of:

operating the drill string in underbalance mode so as to progress the borehole until a treatment zone in the earth formation is reached, which treatment zone includes the fracture or the highly permeable formation, for which treatment is desired;

stopping the drilling operation when the treatment zone is arranged adjacent to the part of the borehole which is selected by the arrangement of the sealing means on the drill string;

moving the sealing means from the retracted mode to the expanded mode thereof so as to seal the drill string relative to the borehole wall; and pumping the stream of treatment fluid via the fluid passage and the outlet into the selected part of the borehole and from there into the treatment zone.

6. An assembly for injecting a stream of fluid into an earth formation using a borehole formed in the earth formation, the assembly comprising a drill string extending into the borehole, the drill string being provided with at least one sealing means arranged to isolate a selected part of the borehole from the remainder of the borehole, each sealing means being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of fluid, the fluid passage having an outlet debouching into the selected part of the borehole, wherein each sealing means includes an inflatable member movable between a radially retracted position when the sealing means is in the retracted mode and a radially expanded position when the sealing means is in the expanded mode, and wherein each inflatable member is arranged to be inflated by means of the pressure in the fluid passage when the stream of treatment fluid is injected, wherein each inflatable member includes a fluid chamber and an inflation channel having an outlet debouching into the fluid chamber, and wherein the drill string further comprises a means for selectively providing fluid communication between the inflation channel and the fluid passage, and wherein the means for selectively providing fluid communication comprises a tubular sleeve arranged on the inner surface of a tubular portion of the drill string, wherein the tubular sleeve is axially movable between a closing position and an opening position with respect to a port through the wall of the tubular portion, and wherein moving the tubular sleeve from the closing to the opening position opens fluid communication through the port, and thereby between the fluid passage, of which the interior of the tubular portion forms part, and the inflation channel.

7. The assembly according to claim 6, wherein the fluid passage also includes a port through the wall of the tubular portion, and wherein the tubular sleeve also forms a means for selectively providing fluid communication through the fluid passage;

wherein axially moving tubular sleeve from the closing to the opening position allows fluid communication through the port, and thereby through the fluid passage.

8. The assembly according to claim 6, wherein the tubular sleeve is biased into the closing position by means of a spring and comprises a seat for a ball or dart, and wherein the sleeve is movable to the opening position by dropping the ball or dart through the drill string on the seat and exerting fluid pressure on the ball or dart.

9. The assembly according to claim 8, wherein the ball or dart is arranged to pass through the seat when the pressure forcing the ball or dart on the seat is increased above a predetermined value.

10. The assembly according to claim 6, wherein the drill string is provided with pressure reducing means for reducing the fluid pressure in the stream of fluid as the stream leaves the outlet, compared to the fluid pressure in the inflatable member.

11. The assembly according to claim 10, wherein the pressure reducing means is formed by the outlet of the fluid passage having a reduced flow area compared to the fluid passage.

12. The assembly according to claim 6, wherein each sealing means is rotatable relative to the longitudinal axis of the drill string.

13. The assembly according to claim 6, wherein the drill string further comprises a deflation channel allowing fluid to flow, when no stream of treatment fluid is injected, from the fluid chamber of the inflatable member to an outlet debouching into the selected part of the borehole.

14. The assembly according to claim 6, wherein the sealing means includes a primary sealing means arranged so that the outlet of the fluid passage is located between the primary sealing means and the lower end of the drill string.

15. The assembly according to claim 14, wherein the outlet of the fluid passage is formed by one or more nozzles in the drill bit.

16. The assembly according to claim 14, wherein the sealing means includes a secondary sealing means arranged so that the outlet of the fluid passage is located between the primary sealing means and the secondary sealing means.

17. A method of injecting a stream of treatment fluid into an earth formation in the course of drilling a borehole into the earth formation, so as to suppress fluid communication between the borehole and a fracture or a highly permeable region in the earth formation, using an assembly comprising a drill string extending into the borehole, the drill string being provided with at least one sealing means arranged to isolate a selected part of the borehole from the remainder of the borehole, each sealing means being movable between a radially retracted mode in which the sealing means is radially displaced from the borehole wall and a radially expanded mode in which the sealing means is biased against the borehole wall so as to seal the drill string relative to the borehole wall, the drill string further being provided with a fluid passage for the stream of fluid, the fluid passage having an outlet debouching into the selected part of the borehole, wherein each sealing means includes an inflatable member movable between a radially retracted position when the sealing means is in the retracted mode and a radially expanded position when the sealing means is in the expanded mode, and wherein each inflatable member is arranged to be inflated by means of the pressure in the fluid passage when the stream of treatment fluid is injected, wherein each inflatable member includes a fluid chamber and an inflation channel having an outlet debouching into the fluid chamber, and wherein the drill string further comprises a means for selectively providing fluid communication between the inflation channel and the fluid passage, and wherein the means for selectively providing fluid communication comprises a tubular sleeve arranged on the inner surface of a tubular portion of the drill string, wherein the tubular sleeve is axially movable between a closing position and an opening position with respect to a port through the wall of the tubular portion, and wherein moving the tubular sleeve from the closing to the opening position opens fluid communication through the port, and thereby between the fluid passage, of which the interior of the tubular portion forms part, and the inflation channel, which method comprises the steps of:

operating the drill string so as to progress the borehole until a treatment zone in the earth formation is reached, which treatment zone includes the fracture or the highly permeable region, for which treatment is desired;

stopping the drilling operation when the treatment zone is arranged adjacent to the part of the borehole which is selected by the arrangement of the sealing means on the drill string;

moving the sealing means from the retracted mode to the expanded mode thereof so as to seal the drill string relative to the borehole wall; and pumping the stream of treatment fluid via the fluid passage and the outlet into the selected part of the borehole and from there into the treatment zone, wherein the drill string is rotated during pumping and/or during a curing period of the treatment fluid after pumping.

* * * * *